United States Patent [19]

Shelley

[11] Patent Number: 4,749,038

[45] Date of Patent: Jun. 7, 1988

[54] METHOD OF DESIGNING A FRACTURING TREATMENT FOR A WELL

[75] Inventor: Robert F. Shelley, Littleton, Colo.

[73] Assignee: Halliburton Company, Del.

[21] Appl. No.: 843,464

[22] Filed: Mar. 24, 1986

[51] Int. Cl.[4] ..... E21B 43/267; E21B 47/06

[52] U.S. Cl. ..... 166/250; 166/280; 73/155

[58] Field of Search ..... 166/250, 280, 308; D3/155

[56] References Cited

U.S. PATENT DOCUMENTS

| | | | |
|---|---|---|---|
| 3,321,965 | 5/1967 | Johnson et al. | 73/155 |
| 3,896,877 | 7/1975 | Vogt, Jr. et al. | 166/250 |
| 4,078,609 | 3/1978 | Pavlich | 166/280 X |
| 4,328,705 | 5/1982 | Gringarten . | |
| 4,372,380 | 2/1983 | Smith et al. | 166/250 |
| 4,393,933 | 7/1983 | Nolte et al. . | |
| 4,398,416 | 8/1983 | Nolte | 166/250 X |
| 4,415,035 | 11/1983 | Medlin et al. | 166/250 X |
| 4,635,719 | 1/1987 | Zoback et al. | 166/250 |

OTHER PUBLICATIONS

Webster, K. R. et al., "A Continuous Multistage Fracturing Technique", *Journal of Petroleum Technology*, vol. 17, No. 6, Jun. 1965, pp. 619–625.

*Primary Examiner*—George A. Suchfield
*Attorney, Agent, or Firm*—Robert A. Kent

[57] ABSTRACT

A fracturing treatment schedule, including several phases of fracturing fluid quantities and corresponding concentations, is designed within maximum constraints imposed by a job pump time and a critical proppant concentration which are derived in response to a monitored pressure versus time test in the well. Intermediate factors used in quantifying the job pump time and the critical proppant concentration are derived from emiprically created correlations to a particular parameter derived from the pressure versus time graph. The parameter is specifically defined as a pump-in test leak-off factor corresponding to the time in minutes for the monitored pressure to decrease a predetermined amount from the pressure level existing at a predetermined time after the well has been shut-in during the test.

14 Claims, 3 Drawing Sheets

METHOD OF DESIGNING A FRACTURING TREATMENT FOR A WELL

BACKGROUND OF THE INVENTION

This invention relates generally to methods of designing a fracturing treatment for a well and more particularly, but not by way of limitation, to methods of designing a schedule for flowing a proppant-laden fracturing fluid into a well.

It is well known that in developing an oil or gas well, a section of the well bore traversing the formation to be produced is sometimes subjected to a hydraulic fracturing treatment to enhance the flowability of the treated zone. In general, a fracturing treatment includes applying a fluid pressure to the geological structure of the zone until the structure is suitably broken, or fractured. Often this process is performed in three general stages: the pre-pad stage during which an ungelled, relatively thin fluid is injected into the well for conditioning the zone to be fractured; the pad stage during which a gelled fluid is injected for initiating the structural breaking; and the proppant stage during which fracturing fluid carrying proppant is injected to fracture the zone further and to keep the created fractures open once the fracturing fluid flows out.

Although the general principle of fracturing and the general stages in which a fracturing treatment is performed are well known, the specific design of a fracturing treatment job for a particular well must be determined for that well because each well has its own characteristics regarding how much fracturing fluid and proppant it will accept. What must be particularly designed is a schedule of phases having specific quantities of fracturing fluid and, for the proppant stage, specific concentrations of proppant assigned to each phase.

The design or assignment of particular quantities and concentrations for a specific treatment has in the past been to some degree as much art as science despite the monitoring of various physical parameters in the well bore. The imprecision which can arise from the "artistic" nature of such designs can result in inadequate fracturing, whereby the well does not produce as it could or whereby additional time and money are spent to perform another fracturing treatment.

Previously, some fracturing treatment jobs have been designed based upon the field experience of personnel treating other wells in the same area. More recently this experience has been supplemented by computer-aided designs utilizing various parameters related to the particular job and the particular well bore (for example, gross vertical fracture height and net vertical length or height in the well bore of the zone to be treated). A shortcoming of this type of design is that it primarily relies on the "artistic" ability of the treatment designer to assimilate the data from the other wells and to extrapolate from that data the proper specific criteria for the particular well to be treated.

A more "scientific" method of fracturing treatment design is theoretically based on several specific monitored parameters such as well bore pressure, fracture height and time-to-closure pressure. Although this technique tends to overcome the shortcoming of relying so much on the ability of the human designer required in the aforementioned prior technique, a specific implementation of this more "scientific" method (generally referred to as the "mini-frac" technique) requires pumping into the well bore a gelled test fluid that is the same composition as the fracturing fluid to be subsequently used when fracturing, and it also requires obtaining the values of several parameters from the well bore for use in the theoretical analysis. The gelled fluid necessitates additional chemicals to create the gelled fluid and the need to know the values of several physical parameters necessitates the use of wireline surveys, time and pumping, all of which cost additional money.

By way of further background and introduction to the present invention, reference is made to a pre-print of a paper to be published in the near future as SPE 15151 of the Society of Petroleum Engineers, the entire disclosure of which is incorporated herein by reference.

In view of the foregoing shortcomings of the potential for inadequate design on the one hand in the first-mentioned prior technique and the expensive theoretical design on the other hand in the second-mentioned prior technique, there is the need for an improved method of designing a fracturing treatment for a well. Such an improved method should provide a reliable design which will produce a proper fracturing treatment, but it should do so in a more economical manner than suggested by the more "scientific" prior art method. Furthermore, such an improved method should be convenient for personnel to use in the field at the well site; such use should also be capable of performance within a relatively short time to enhance further the financial economy of the improved method.

SUMMARY OF THE INVENTION

The present invention overcomes the above-noted and other shortcomings of the prior art and meets the aforementioned needs by providing a novel and improved method of designing a fracturing treatment for a well. The method of the present invention is an empirically based design using correlations which I have discerned from data obtained from many wells. My method is implemented by observing only a single physical phenomenon in the specific well bore to be treated and then applying the empirically developed relationships to determine a maximum job pump time and a critical proppant concentration from which the schedule of phases of fracturing fluid quantities and proppant concentrations is developed.

By applying my discovery to different wells in different areas, I have found that my basic correlations produce reliable designs for such different wells. Furthermore, no extensive or expensive testing is required to obtain multiple parameters for plugging into a theoretical relationship because the implementation of my inventive method is initiated through the use of a single monitored physical phenomenon, the pressure versus time in the well bore as monitored at the surface in a manner well known to the art. Such pressure monitoring is believed to always, or almost always, be done anyway so that no additional testing equipment is generally needed to utilize my invention. Furthermore, this pressure monitoring is done in response to the injection of an ungelled test fluid which is a more economical test fluid than I believe is required in the aforementioned "mini-frac" technique.

My method is conveniently implemented at the well site by the designer making a graphical analysis or by performing the analysis on a computer. Such implementation can be completed within a relatively short time since only the single pressure versus time monitoring is needed and since the analysis from the empirically developed correlations is straightforward.

Broadly, the present invention provides a method of designing a fracturing treatment for a well, comprising determining a parameter in correspondence to a nonzero rate of change of pressure in the well, and defining in response to the parameter a schedule of at least one quantity of fracturing fluid and at least one concentration of proppant in the fracturing fluid.

In a specific implementation of my method, the step of determining a parameter includes flowing an ungelled fluid into the well, shutting-in the well, and monitoring the pressure in the well. In this implementation, the parameter is a length of time it takes the pressure in the well to decrease a predetermined amount.

In this specific implementation, the step of defining a schedule includes determining a maximum treatment pump time in response to the parameter; determining a maximum total proppant concentration in response to the parameter, and composing the schedule in response to the maximum treatment pump time and the maximum total proppant concentration. Composing the schedule includes specifying a plurality of proppant emplacement phases to be serially implemented for placing a total quantity of fracturing fluid and a total concentration of proppant in the well within the maximum treatment pump time and the maximum total proppant concentration. The specifying step more particularly includes assigning to each proppant emplacement phase a respective quantity of fracturing fluid to be flowed during the respective phase and assigning to each proppant emplacement phase a respective concentration of proppant to be placed in the respective quantity of fracturing fluid for the respective proppant emplacement phase.

Therefore, from the foregoing, it is a general object of the present invention to provide a novel and improved method of designing a fracturing treatment for a well. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

In describing the preferred embodiment of the present invention, an example will be used wherein it will be assumed that the well to be treated is cased and that a known length (specifically 15 feet in the assumed example) of the casing has been perforated by any suitable technique, various ones of which are known to the art. The length of the perforated segment of the casing corresponds to the length of the zone to be treated by the fracturing treatment designed in accordance with the present invention because the fracturing fluid is injected into the formation through the perforations as known to the art. Once the casing has been perforated, the well is broken down and the perforations are balled-off in manners as known to the art.

It is to be noted that the present invention does not pertain to the fracturing fluid injection equipment or method itself, but rather it pertains to the schedule of phases of quantities of fracturing fluid and concentrations of proppant to be injected by any such suitable equipment known to the art. Within such known equipment is a pump means for pumping the fluid in accordance with the designed treatment. This pump means is operable at a selectable rate, which in the example used herein will be selected as 37 barrels per minute (bpm).

The method of designing the fracturing treatment in accordance with the present invention broadly includes the steps of determining a parameter in correspondence to a nonzero rate of change of pressure in the well and of defining in response to the parameter a schedule of at least one quantity of fracturing fluid and at least one concentration of proppant in the fracturing fluid. It is to be noted that the fracturing fluid and proppant referred to herein are of suitable types as known to the art, and their specific compositions are not critical to the practicing of the present invention.

The step of determining a parameter includes flowing (specifically, pumping) a test fluid into the well. In the preferred embodiment the well bore is first loaded with fluid and then 10,000 gallons of a pre-pad fluid without fluid loss additives are pumped into the well. In general, the test fluid is any suitable fluid, but preferably it is an ungelled fluid or other relatively thin fluid which can be more economically obtained and flowed (specifically, pumped) into the well than the gelled test fluid needed in the prior art "mini-frac" method.

Figure 1:
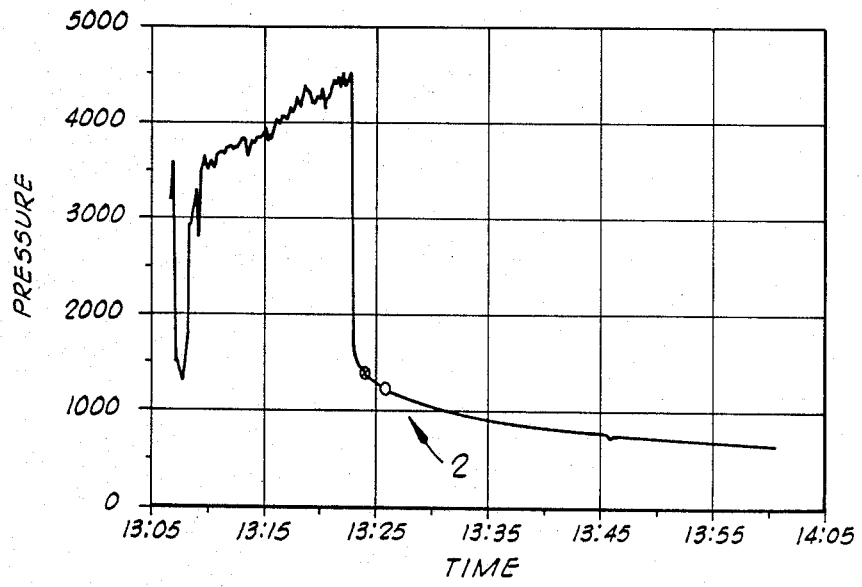
FIG. 1 is a graph representing the monitored pressure versus time of a well which is to receive a fracturing treatment job designed in accordance with the present invention.

After the test fluid has been flowed into the well, the well is shut-in and the pressure is monitored over time, both of which steps further more specifically define the general step of determining a parameter. In the preferred embodiment this monitoring occurs at the surface for a suitable length of time, such as approximately twenty or thirty minutes. A record of the pressure versus time is kept, such as by creating a graphical representation as illustrated in FIG. 1. In the example illustrated in FIG. 1, the pressure is monitored from approximately 13:07 on the day the treatment is to be designed and performed (it should be noted one advantage of the present invention is that the treatment design can be prepared in a relatively short time so that the treatment can be performed without a substantial delay; for example, both the design and treatment can occur within the same day). FIG. 1 further shows that the exemplary well was shut-in at approximately 13:23 (more particularly, 13:22:30 as shown by the enlarged scale of FIG. 2) and that the subsequent pressure decline was recorded for more than 20 minutes to approximately 14:01.

From the record of the monitored pressure versus time, the parameter to be determined is selected in relation to a selected rate of change of the monitored pressure. In the preferred embodiment the parameter is the length of time it takes the pressure in the well to decrease a predetermined amount from a monitored pressure existing at a predetermined time after the well was shut-in. In the preferred embodiment this predetermined time is a suitable time after shut-in when pressure transients in the monitored pressure have dissipated. Stated differently, this parameter is the time period of the selected rate of change. This time period parameter is referred to in the inventive method as the pump-in test leak-off factor (PILF).

In the specific example illustrated in the drawings, the PILF is specifically defined as the time (in minutes) for the pressure to decrease 200 pounds per square inch (psi) from the pressure level existing at one minute after the shut-in time. The illustrated method for determining this is by making the graphical plot of the shut-in data and smoothing any early time anomalies (such as with a French curve) as shown in FIG. 1. This step could also be performed in a computer having the shut-in data recorded for analysis. The graphically represented data are obtained from any suitable pressure recording source, such as IMPACT disks or COMPUVAN TM system equipment (a trademark of Halliburton Company).

Figure 2:
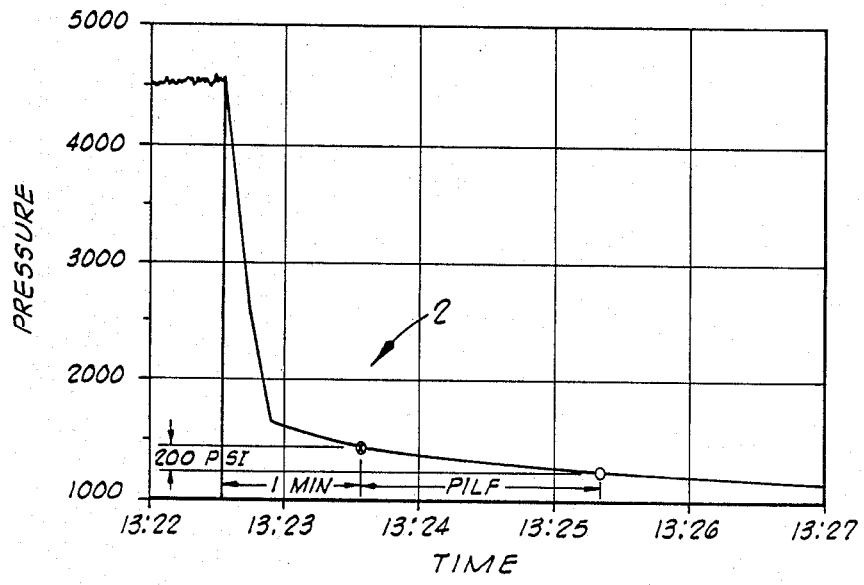
FIG. 2 is a graph, on an enlarged time scale, of a portion of the graph shown in FIG. 1.

Accurate determination of the pressure after the one-minute-from-shut-in start point is critical; therefore, it is convenient to plot the critical portion of the FIG. 1 curve on an expanded scale as shown in FIG. 2. FIG. 2 specifically shows the portion identified in FIG. 1 by the reference numeral 2. From FIG. 2 the 200 psi pressure drop occurring from the one-minute start point results in a PILF of 1.8 minutes.

It is to be noted that in the specific example illustrated in the drawings, the 200 psi pressure drop has been selected simply as a convenient number; that is, other quantities of pressure drops may be used, but whatever is selected should be consistently used so that consistent comparisons can be made from one design to the next. Similarly, the one-minute wait after the shut-in time has been selected as a convenient number so that other shut-in times can be used; however, the time chosen should be one which is beyond the period during which pressure transients occur after shut-in, and once a time is chosen it should be used to maintain consistency from one design to another.

For the preferred embodiment of the present invention, the step of defining a schedule in response to the determined parameter generally includes creating, in response to the time it takes the monitored pressure to decrease a predetermined amount from a monitored pressure existing at a predetermined time after the well is shut-in, a schedule of quantities of fracturing fluid to be flowed into the well and associated concentrations of proppant to be carried by the quantities of fracturing fluid. More particularly, this step includes determining a maximum treatment pump time in response, or correlated, to the parameter derived in correspondence to the rate of change of pressure in the well from the post-shut-in start point (i.e., in correlation to the PILF). The maximum treatment pump time is determined by selecting a sandout condition pressure, selecting a pressure increase rate correlated to the PILF time parameter, and dividing the sandout condition pressure by the pressure increase rate to define the maximum job pump time.

The sandout condition pressure in the preferred embodiment is selected as 1,600 psi; however, another pressure can be selected as the sandout condition pressure, but such pressure value is contemplated to be within the range between approximately 1,200 psi and approximately 2,000 psi. That is, the sandout condition pressure is not selected so much for convenience in the manner in which the aforementioned 200 psi pressure drop and one-minute-after-shut-in time values were selected because the sandout condition pressure is related to a specific physically identifiable phenomenon.

Figure 3:
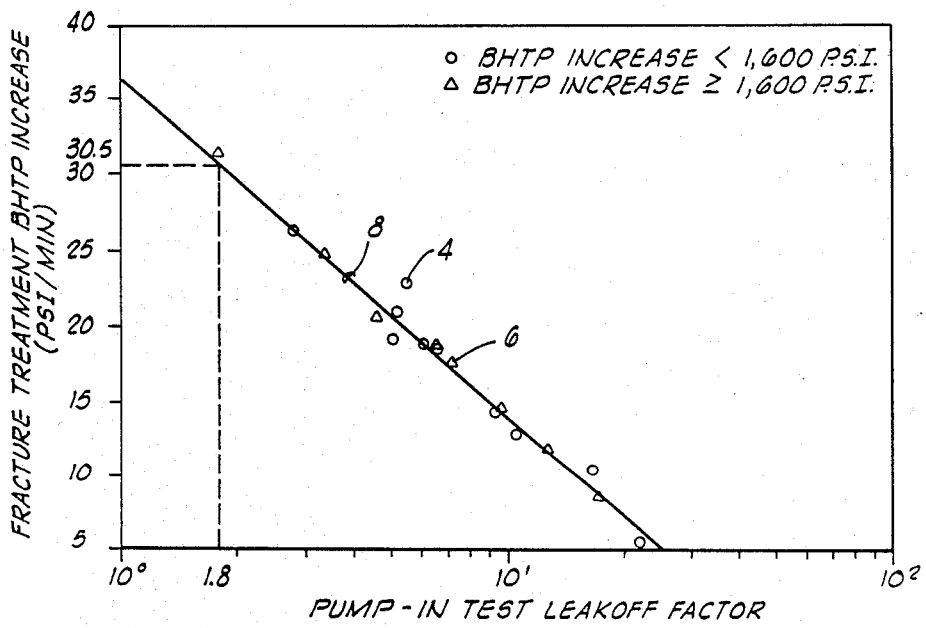
FIG. 3 is a graph empirically developed to correlate fracture treatment bottom hole treating pressure increase rates to pump-in test leak-off factors.

The pressure increase rate selected in the preferred embodiment of the present invention is particularly an average fracture treatment bottom hole treating pressure (BHTP) increase rate which I have determined to be inversely correlated or proportional to the PILF time parameter. This is represented in FIG. 3, which depicts a graph empirically derived from actual data observed in wells in the Williston Basin of North Dakota. In FIG. 3 the actual data points representing bottomhole treating pressure increases less than 1,600 psi are represented by the circular symbols 4 and BHTP increases greater than or equal to 1,600 psi are shown by the triangular symbols 6. The solid line 8 is the extrapolated relationship I have derived to correlate the fracture treatment BHTP increase rate to the PILF. The scale used in FIG. 3 shows that the relationship is particularly an inverse logarithm relationship; in general, however, as the PILF increases, the corresponding pressure increase rate decreases. For the exemplary 1.8 minute PILF determined from FIG. 2, the corresponding or correlated fracture treatment BHTP increase rate is 30.5 psi/minute.

By dividing the exemplary 1,600 psi sandout condition pressure by the exemplary 30.5 psi/minute fracture treatment BHTP increase rate, the maximum job pump time for the exemplary PILF determined from FIG. 2 is approximately 52.5 minutes.

The actual data points shown in the FIG. 3 graph were determined by dividing the actual pressure by the treatment pump time, which treatment pump time was equated to the total gelled fluid pump volume plus the proppant volume divided by the pump rate for the various wells.

The step of defining the schedule in response to the PILF in the preferred embodiment also includes determining a maximum or critical total proppant concentration in response to, or correlated to, the PILF parameter. To determine this total concentration factor, an average fracture treatment leak-off rate (FTLR) is determined in response to the PILF time parameter. The FTLR has been found to be inversely correlated or proportional to the PILF and directly proportional to the length of the portion of the well to be treated (this corresponds to the length of the perforated segment in the particular example described herein). These relationships are graphically depicted in FIG. 4 which has also been empirically developed from information obtained from wells in the Williston Basin of North Dakota. As with the pressure increase rate factor shown in FIG. 3, the FTLR is particularly shown in FIG. 4 to have an inversely logarithmic relationship to the PILF parameter represented along the horizontal logarithmic scale in FIG. 4.

Figure 4:
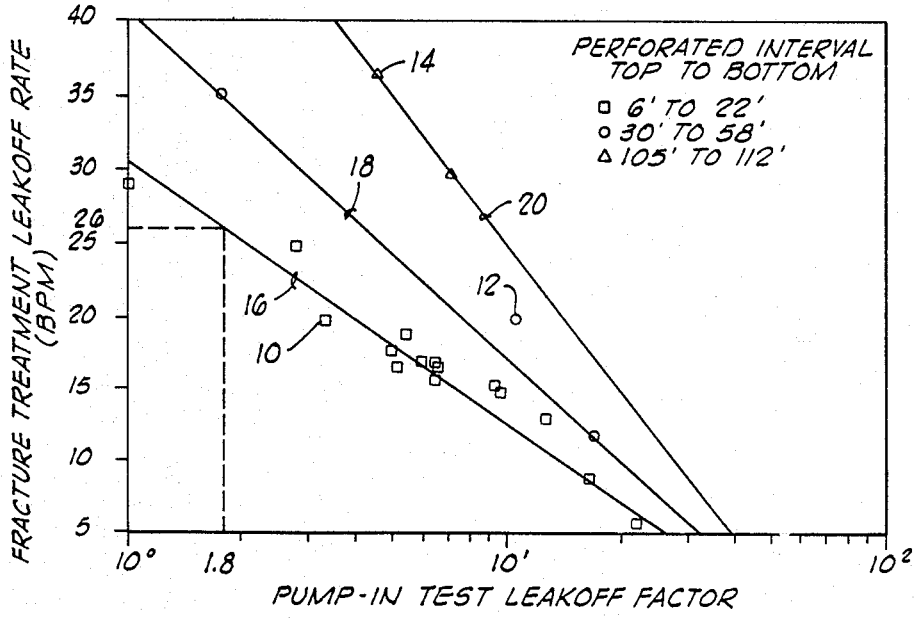
FIG. 4 is a graph empirically developed to correlate fracture treatment leak-off rates to pump-in test leak-off factors.

The square symbols 10 shown in FIG. 4 designate actual data points for a single zone perforated interval of between 6 and 22 feet; the circular symbols 12 designate actual data points of a single zone perforated interval of 30 feet to 58 feet; and the triangular symbols 14 represent actual data points for a dual zone perforated interval of 105 feet to 112 feet. The dispositions of these different data points show that for a particular PILF, the FTLR is greater for longer perforated treatment zones.

In the example described herein, the perforated zone is 15 feet and the PILF is 1.8 minutes; therefore, the FTLR taken from the graph line 16, which represents the extrapolated correlation between the FTLR and the PILF for a single perforated zone of between 6 and 22 feet, is 26 barrels per minute (bpm) (graph line 18 represents the extrapolated correlation for a single perforated zone between 30 feet and 58 feet in length and graph line 20 represents the extrapolated correlation for dual perforated zones between 105 feet and 112 feet in length). A further refinement to the graph of FIG. 4 which may preferably be used for design purposes is shown in SPE 15151 hereinbefore identified.

Also needed for determining the total proppant concentration factor in the preferred embodiment is the pump rate selected or defined for pumping fracturing fluid into the well. This rate is whatever the rate is to be for the known equipment to be used in performing the fracturing treatment. As previously stated in the example referred to herein this pump rate is 37 bpm.

The FTLR factor is divided by this pump rate to define a free water factor (FWF) quotient which is in turn used to determine the critical proppant concentration.

The critical proppant concentration can be graphically determined as was done in determining the pressure increase rate from FIG. 3 and the FTLR from FIG. 4; however, in the preferred embodiment this determination is done by utilizing the following mathematical formula representing the relationship between the critical proppant concentration and the FWF (which relationship can be derived by directly using the FTLR/pump rate expression without first separately computing that quotient as the FWF):

$$\text{critical proppant concentration} = \frac{1 - FWF}{(a)(FWF) + (b)},$$

where a=absolute volume factor for the proppant (gallons/pound), and b=void volume factor for the proppant bed (gallons/pound).

In the described example, it will be assumed that the proppant is a suitable sand so that this total concentration factor is particularly referred to as a critical sand concentration (CSC). For this particular proppant, a=0.0456 gallons/pound and b=0.03 gallons/pound. In general, however, other suitable proppants known to the art can be used, which other proppants have respective a and b factors as also known to the art.

For the example described herein, the FTLR is determined from FIG. 4 to be 26 bpm and the pump rate is selected to be 37 bpm, whereby the FWF is approximately 0.70. Inserting 0.70 and the aforementioned specific values of a and b into the foregoing equation, the CSC is computed to be approximately 4.84 pounds of proppant sand per gallon of fracturing fluid. The CSC (or, more generally, the critical proppant concentration) represents the concentration that occurs when the inlet fluid available to leakoff is equivalent to the average fracture treatment leakoff rate.

It should be noted that although in the preferred embodiment graphical representations of the correlations shown in FIGS. 3 and 4 were used for determining the fracture treatment BHTP increase rate and the FTLR, these graphically depicted representations can be reduced to mathematical equations which can be readily used, such as in a computer, in a manner similar to the equation used for computing the maximum total proppant concentration from the FTLR and the pump rate.

Having determined the maximum treatment pump time and the critical proppant concentration, the schedule of fracturing fluid quantities and corresponding proppant concentrations can be properly composed. Such composition includes specifying a plurality of proppant emplacement phases to be serially implemented for placing a total quantity of fracturing fluid and a total concentration of proppant in the well within the maximum treatment pump time and the maximum total proppant concentration. This more particularly includes assigning to each proppant emplacement phase a respective quantity of fracturing fluid to be flowed during the respective phase and assigning to each proppant emplacement phase a respective concentration of proppant to be used in the respective quantity of fracturing fluid for the respective proppant emplacement phase. In the preferred embodiment, these phases constitute the proppant stage of the previously described generalized three-stage fracturing technique.

Although the maximum pump time and the critical proppant concentration are used to limit the overall size of the treatment and to aid in designing the distribution of proppant among the phases, the specific designation of quantities and concentrations within each phase can be adjusted as desired; however, my experience has shown that the following guidelines are useful in making the specific assignments. In general, these guidelines include assigning quantities of fracturing fluid and corresponding concentrations of proppant so that approximately two-thirds of the total proppant to be placed is assigned to be placed at concentrations less than the maximum total proppant concentration (i.e., the CSC in the preferred embodiment). Furthermore, at least five proppant emplacement phases should be used with each successive proppant emplacement phase being assigned a progressively larger concentration of proppant. Each larger concentration amount should be a constant amount greater than the preceding one.

An additional guideline is that a non-proppant emplacement phase should be specified prior to the proppant emplacement phases. This corresponds to the second, or pad, stage of the generalized three-stage fracturing treatment program. In this non-proppant emplacement phase, the quantity of fracturing fluid assigned to it should be sufficient to constitute a quantity within the basic range between approximately five percent and approximately sixty percent of the total quantity of fracturing fluid assigned to all of the non-proppant emplacement and proppant emplacement phases. A more preferred range is between approximately twenty percent and approximately fifty percent, and a most preferred range is between approximately thirty percent and approximately forty percent.

The foregoing guidelines have been developed so that the majority of the proppant can be placed in the formation before the CSC level is reached because when this level is reached, it has been determined that rapid pressure increases can be encountered. These rapid pressure increases can adversely affect the ability to place further amounts of proppant in the formation.

For the maximum pump time of 52.5 minutes and critical proppant concentration of 4.84 pounds per gallon previously determined for the example described herein, and in accordance with the foregoing guidelines, the following schedule has been composed for the well having the 1.8 minute PILF determined from the exemplary pressure versus time graph of FIGS. 1 and 2:

| Fracturing Fluid Quantity (gallons) | Proppant Concentration (pounds per gallon) |
|---|---|
| 26,000 | — |
| 5,000 | 1.0 |
| 10,000 | 2.0 |
| 15,000 | 3.0 |
| 8,000 | 4.0 |
| 6,000 | 5.0 |
| 4,000 | 6.0 |

From this table it can be determined that the total scheduled gallonage is 74,000 gallons of fracturing fluid, which is within the capability of a pump pumping at 37 barrels per minute for the maximum pump time of 52.5 minutes.

The table also shows that the total proppant scheduled to be placed equals 156,000 pounds, which computes to a total concentration of 3.25 pounds per gallon of proppant for the 48,000 gallons of proppant assigned to the proppant emplacement phases specified in the table. This total concentration is within the critical proppant concentration of 4.84 computed in accordance with the present invention.

The table also shows that the schedule has been defined to include at least five proppant emplacement phases (specifically, six phases) with each successive phase having a larger concentration assigned to it. Each such larger concentration is a constant increment from the concentration of the preceding phase. These concentrations have also been assigned whereby 102,000 pounds of the proppant are scheduled to be placed at concentrations less than the 4.84 critical proppant concentration so that approximately twothirds of the proppant is scheduled to be placed at less than the CSC (102,000/156,000=65.4%). Similarly, the 26,000 gallons of non-proppant laden fracturing fluid scheduled as the first-listed phase in the table constitutes approximately 35% of the total fluid to be placed in all of the scheduled phases, which is within the 30%–40% range of the aforementioned guidelines.

Figure 5:
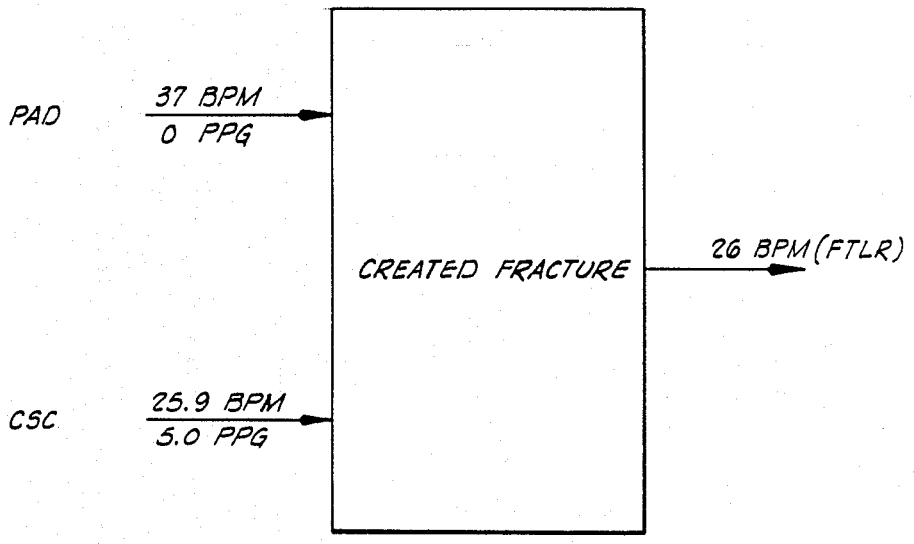
FIG. 5 is a schematic representation of the fluid balance on the fracture for a specific example described in the subsequent detailed description of the preferred embodiment of the invention.

From the foregoing, the fluid balance on the created fracture shows that at the 37 barrel per minute pump rate there will be sufficient fracturing fluid flowed into the created fracture to account for the 26 barrel per minute FTLR during the phase when only the fluid is pumped into the fracture. For the 4.84 CSC, there will be a sufficient amount of fluid to approximately equal the fluid loss indicated by the FTLR. This is pictorially depicted in FIG. 5, from which one can visually observe how the formation appears to limit proppant concentrations and how proppant volume is substituted for fluid volume available to leakoff (in FIG. 5, BPM stands for barrels per minute and PPG stands for pounds per gallon).

In addition to the foregoing description, reference is also made to SPE 15151 hereinbefore identified.

In summary of the present invention, one starts with the known parameters of the pump rate at which it is anticipated the fracturing treatment fluid will be pumped into the well and of the length of the formation to be treated. The only parameter which needs to be monitored or specifically developed is the pressure versus time record so that the PILF time parameter can be determined. From this single monitored physical phenomenon of pressure versus time, the remaining analysis of the present invention is performed by utilizing the correlations I have developed as depicted in FIGS. 3 and 4 (or the mathematical equations which can be derived therefrom) and the mathematical equation for determining the CSC from the FWF (or a corresponding graphical correlation thereof). In particular, a maximum pump time and a critical proppant concentration are developed for defining the maximum constraints on the ultimate schedule to be designed. A generalized correlation between the PILF and the pump time and concentration factors is that the longer or greater the time factor representing the PILF, the more or greater are both the pump time and the CSC, thereby indicating that more proppant can be placed in a well having a slower rate of pressure decrease from which the PILF is determined.

Although the foregoing describes the preferred embodiment of my invention, an additional guideline which is not part of my invention but which is prudent to perform before designing a fracturing treatment is the known step of determining perforation friction. This is determined in accordance with the following equation:

$$P_{pf}=P_w-P_p-ISIP,$$

where:

$P_{pf}$=perforation friction $P_w$=wellhead pressure before shut-in $P_p$=pipe friction before shut-in ISIP=instantaneous shut-in pressure.

Excessive perforation friction may hinder proppant placement. In some instances, perforation friction greater than 1000 psi has been found to hinder proppant placement. It is also noted that pipe friction is difficult to determine with fluids that have friction reducer because of the inconsistent mixing procedures. A 40 lb/Mgal gel (comprising an uncrosslinked viscosified fluid utilizing conventional polysaccharide gelling agents) is a preferred fluid for the determination of pipe friction. Another suitable fluid is straight 2% KCl water or diesel.

In conclusion, this inventive procedure has been developed empirically from wells in a particular formation (specifically, the Madison formation in the Williston Basin); however, it has since proven to be predictive in at least one other area. Thus, I have found the surprising and unexpected result that a fracturing treatment can be simply designed from the analysis of the pressure/time data after an injection test. It is contemplated that this technique will be useful in predicting the behavior of a well in a potentially naturally fractured reservoir as well as in other situations. This invention is especially valuable in those areas where well-to-well treatment predictions are unreliable. It is also of value in that it can be performed relatively inexpensively both in terms of expenditures of time and of money.

The correlations developed as set forth hereinabove were developed using delayed crosslinked systems employing particulate and/or liquid hydrocarbon fluid loss materials in the treatment. The particular proppant employed in the development of the foregoing correlation comprised of 20/40 Mesh proppant on the U.S. Sieve Series. It is to be understood that a similar correlation to that described here and before can be derived for any other size proppant.

Thus, the present invention is well adapted to carry out the objects and attain the ends and advantages mentioned above as well as those inherent therein. While a preferred embodiment of the invention has been described for the purpose of this disclosure, numerous changes in the performance of steps can be made by those skilled in the art, which changes are encompassed within the spirit of this invention as defined by the appended claims.

What is claimed is:

1. A method of designing a fracturing treatment for a well, comprising:
   flowing a test fluid into the well;
   shutting-in the well;
   monitoring the pressure in the well;
   determining a parameter in correspondence to a change of pressure in the well comprising the length of time it takes the pressure in the well to decrease a predetermined amount;
   determining a maximum treatment pump time in response to said parameter by selecting a sandout condition pressure and determining a bottomhole treating pressure increase rate in response to said parameter and dividing said sandout condition pressure by said bottomhole treating pressure increase rate whereby said maximum treatment pump time is determined;
   determining a maximum total proppant concentration in response to said parameter; and
   composing a schedule of at least one quantity of fracturing fluid and at least one concentration of proppant in response to said maximum treatment pump time and said maximum total proppant concentration.

2. A method as defined in claim 1, wherein said bottomhole treating pressure increase rate is inversely proportional to said parameter.

3. A method as defined in claim 5, wherein said sandout condition pressure is a pressure value within the range between approximately 1,200 pounds per square inch and approximately 2,000 pounds per square inch.

4. A method as defined in claim 1, wherein determining a maximum total proppant concentration includes:
   determining a fracture treatment leak-off rate in response to said parameter;
   selecting a pump rate for pumping fracturing fluid into the well; and
   computing said maximum total proppant concentration from said fracture treatment leak-off rate and said pump rate.

5. A method as defined in claim 4, wherein said fracture treatment leak-off rate is inversely proportional to said parameter.

6. A method as defined in claim 4, wherein said fracture treatment leak-off rate is directly proportional to the length of the portion of the well to be treated.

7. A method as defined in claim 4, wherein computing said maximum total proppant concentration includes dividing the numerical quantity by the numerical quantity.

8. A method as defined in claim 1, wherein composing said schedule includes specifying a plurality of proppant emplacement phases to be serially implemented for placing a total quantity of fracturing fluid and a total concentration of proppant in the well within said maximum treatment pump time and said maximum total proppant concentration, said specifying including assigning to each proppant emplacement phase a respective quantity of fracturing fluid to be flowed during the respective phase and assigning to each proppant emplacement phase a respective concentration of proppant to be used in the respective quantity of fracturing fluid for the respective proppant emplacement phase.

9. A method as defined in claim 8, wherein the quantities of fracturing fluid and the concentrations of proppant are assigned so that approximately two-thirds of the total proppant to be placed is assigned to be placed at concentrations less than said maximum total proppant concentration.

10. A method as defined in claim 8, wherein specifying a plurality of proppant emplacement phases includes specifying at least five proppant emplacement phases with each successive proppant emplacement phase being assigned a progressively larger concentration of proppant.

11. A method as defined in claim 8, wherein composing said schedule further includes specifying a non-proppant emplacement phase having a quantity of fracturing fluid assigned thereto so that the quantity of fracturing fluid assigned to the non-proppant emplacement phase constitutes a quantity within the range between approximately five percent and approximately sixty percent of the total quantity of fracturing fluid assigned to all of the non-proppant emplacement and proppant emplacement phases.

12. A method of designing a fracturing treatment for a well, comprising:
   flowing a test fluid into the well;
   shutting-in the well;
   monitoring pressure in the well over time;
   selecting a parameter comprising the length of time it takes the pressure in the well to decrease a predetermined amount;
   determining a treatment pump time correlated to said parameter by selecting a sandout condition pressure, selecting a pressure increase rate correlated to said parameter and dividing said sandout condition pressure by said pressure increase rate whereby said treatment pump time is determined;
   selecting a leak-off rate correlated to said selected parameter;
   selecting a pump rate for pumping fracturing fluid into the well;
   dividing said leak-off rate by said pump rate to define a quotient;
   determining a critical proppant concentration in correlation to said quotient; and
   composing a schedule of fracturing fluid quantities and proppant concentrations in response to said treatment pump time and said critical proppant concentration.

13. A method of designing a fracturing treatment for a well, comprising:
   flowing a test fluid into the well;
   shutting-in the well;
   monitoring pressure in the well over time;
   determining a pressure decrease time which is the time it takes the monitored pressure to decrease a predetermined amount from a monitored pressure existing at a predetermined time after the well is shut-in;
   selecting a sandout condition pressure;
   determining a fracture treatment bottomhole treating pressure increase rate inversely correlated to said pressure decrease time;
   dividing said sandout condition pressure by said fracture treatment bottomhole treating pressure increase rate to define a job pump time;

determining a fracture treatment leak-off rate inversely correlated to said pressure decrease time;

defining a pump rate for pumping fracturing fluid into the well;

dividing said fracture treatment leak-off rate by said pump rate to define a free water factor;

determining a critical proppant concentration in response to said free water factor; and defining phases within a schedule and assigning fracturing fluid quantities and proppant concentrations to each of the phases in response to said job pump time and said critical proppant concentration.

14. A method as defined in claim 13, wherein said predetermined time is a time after shut-in pressure transients in the monitored pressure have dissipated.

* * * * *

UNITED STATES PATENT AND TRADEMARK OFFICE

CERTIFICATE OF CORRECTION

PATENT NO. : 4,749,038

DATED : June 7, 1988

INVENTOR(S) : Robert F. Shelley

It is certified that error appears in the above-identified patent and that said Letters Patent is hereby corrected as shown below:

In column 11, line 36, the number 5 following the word "claim" should read --1--.

Signed and Sealed this

Eighth Day of November, 1988

*Attest:*

DONALD J. QUIGG

*Attesting Officer*

*Commissioner of Patents and Trademarks*